US007387188B2

(12) United States Patent
Keller et al.

(10) Patent No.: US 7,387,188 B2
(45) Date of Patent: Jun. 17, 2008

(54) SOUND ABSORBER

(75) Inventors: Uwe Keller, Gelnhausen (DE); Hans-Joachim Lowe, Wolfenbuttel (DE); Joachim Von Der Hagen, Altenhaβlau (DE); Dietmar Metz, Meckenheim (DE); Helmut Stonner, Frankenthal (DE)

(73) Assignees: Veritas AG, Gelnhausen (DE); Borgwarner Inc., Chicago, IL (US)

( * ) Notice: Subject to any disclaimer, the term of this patent is extended or adjusted under 35 U.S.C. 154(b) by 188 days.

(21) Appl. No.: 10/928,141

(22) Filed: Aug. 30, 2004

(65) Prior Publication Data

US 2005/0067220 A1 Mar. 31, 2005

(30) Foreign Application Priority Data

Sep. 8, 2003 (DE) ..... 103 41 319

(51) Int. Cl.
*F01N 1/02* (2006.01)
*F01N 1/06* (2006.01)
*F01N 1/00* (2006.01)

(52) U.S. Cl. ..... 181/250; 181/255

(58) Field of Classification Search ..... 181/249, 181/250, 255, 273, 276
See application file for complete search history.

(56) References Cited

U.S. PATENT DOCUMENTS

| | | | | | |
|---|---|---|---|---|---|
| 1,087,397 | A * | 2/1914 | Persson | 181/276 |
| 1,542,829 | A * | 6/1925 | Oldberg | 181/269 |
| 1,821,013 | A * | 9/1931 | Hamilton | 181/266 |
| 1,909,394 | A * | 5/1933 | Dodge | 181/249 |
| 2,138,510 | A * | 11/1938 | Rauen | 181/273 |
| 2,184,891 | A * | 12/1939 | Bourne | 181/273 |
| 3,212,603 | A * | 10/1965 | Walker | 181/250 |
| 3,880,252 | A * | 4/1975 | Mucka | 181/230 |
| 4,314,621 | A * | 2/1982 | Hansen | 181/233 |
| 4,315,558 | A * | 2/1982 | Katayama | 181/227 |
| 4,540,064 | A * | 9/1985 | Fujimura | 181/227 |
| 4,645,032 | A * | 2/1987 | Ross et al. | 181/250 |
| 4,979,587 | A * | 12/1990 | Hirt et al. | 181/213 |
| 5,444,196 | A * | 8/1995 | Woods | 181/227 |
| 5,979,598 | A * | 11/1999 | Wolf et al. | 181/272 |
| 6,715,580 | B1 * | 4/2004 | Gerstner et al. | 181/224 |
| 2005/0150718 | A1 * | 7/2005 | Knight et al. | 181/250 |
| 2005/0279568 | A1 * | 12/2005 | Seyler et al. | 181/249 |

FOREIGN PATENT DOCUMENTS

| | | | |
|---|---|---|---|
| DE | 78 27 573 | | 1/1979 |
| DE | 3431078 | A * | 3/1985 |
| DE | 90 15 414.2 | | 3/1991 |
| DE | 195 04 223 | A1 | 8/1996 |
| DE | 196 38 304 | A1 | 4/1997 |
| EP | 1469186 | A2 * | 10/2004 |

* cited by examiner

*Primary Examiner*—Edgardo San Martin
(74) *Attorney, Agent, or Firm*—Buchanan Ingersoll & Rooney PC

(57) ABSTRACT

A sound absorber includes an inner component and an outer component surrounding the inner component, the inner component defining an inner wall provided with apertures, and the outer component defining an outer wall extending along the inner wall. For improving the sound-absorbing properties as well as the flexibility of the sound absorber, the outer wall is implemented as a bellows which, together with the inner wall, defines individual cavities, the apertures of the inner wall opening into the cavities.

14 Claims, 1 Drawing Sheet

SOUND ABSORBER

BACKGROUND

The present invention relates to a sound absorber comprising an inner component and an outer component surrounding said inner component, said inner component defining an inner wall provided with apertures, and said outer component defining an outer wall extending along said inner wall.

A sound absorber of this type is known from DE 195 04 223 A1.

Sound absorbers are used in the intake system of engines, e.g. in motor vehicles, for reducing noise emission. The German-Offenlegungsschrift 34 31 078 suggests for this purpose a sound absorber consisting essentially of an intake pipe produced from a sound-absorbing, porous material in a certain section thereof, the intake pipe being surrounded by a perforated metal tube in said section. The above-described sound absorber does not satisfy the requirements on the damping ratio, which are higher than they used to be. What is particularly problematic is the damping of noise emitted by engines provided with turbo-charger systems. When such charger systems are in operation, pulsation noise will occur, which is caused by extremely small geometrical irregularities of a compressor impeller of the turbocharger. This pulsation noise occurs proportionally to the rotary frequency of the turbocharger. The frequency band excited in the case of such noise has, due to the large operating speed range, a very wide bandwidth. Hence, sound absorption over a particularly wide bandwidth has to be effected for achieving a general reduction of noise emission.

In DE 195 04 223 A1, it is suggested that the perforated pipe should be used as an intake pipe, said pipe being surrounded by a cylinder with a closed, flat surface. Between the interior perforated intake pipe and the cylinder concentrically surrounding said intake pipe, a broad, uninterrupted annular gap is formed. The apertures provided in the perforated intake pipe are arranged in the area of said annular gap so as to enable said annular gap to communicate with the interior of the intake pipe. The improved sound absorbing properties of this sound absorber originate form the air mass exchange and pressure compensation with the annular gap, which are made possible by the apertures in the intake pipe; the cylinder defining the annular gap prevents pressure losses and causes a further reduction of noise emission.

However, also the damping ratio of this sound absorber is insufficient for achieving a broadband reduction of noise emission, especially in the case of turbo-charged engines.

DE 196 38 304 A1 discloses a sound absorber which is specially conceived for engines with turbochargers. This sound absorber comprises a chamber arranged in the flow channel and provided with a plurality of spaced-apart annular screens which are arranged in parallel. A respective resonance chamber is formed between two neighbouring annular screens, said resonance chamber leading to a reduction of the sound level in a certain frequency range. This sound absorber is disadvantageous insofar as the screens have edges and that the gas flows across these edges. The flow resistance caused by these edges impairs the efficiency of the charger system. In addition, the insertion of the screens into the sound absorber chamber is complicated from the point of view of production technology and, consequently, it entails high costs.

Furthermore, damping systems comprising a plurality of different damping elements, which are configured to be used for different frequency bands and which are arranged in series, are commercially available and used in engines. Such damping systems, however, require an excessively large accommodation space.

It is therefore the object of the present invention to create a sound absorber which is simple to produce and which has good sound-absorbing properties, in particular broadband sound-absorbing properties.

SUMMARY

According to the present invention, this object is achieved by a sound absorber constructed according to the principles of the present invention.

The sound absorber according to the present invention is advantageous insofar as the principle of action of a Helmholtz resonator is combined with the principle of action of a $\lambda/4$ reflector so that low-frequency components as well as components having a higher frequency can be damped. The sound absorber according to the present invention allows the adjustment of a frequency band of damping in accordance with the noise to be damped, which occurs in the respective case of use. In addition, the sound absorber according to the present invention can be produced at a very reasonable price, since special inserts, such as screens or protruding elements, are not necessary.

The sound absorber according to the present invention requires only little accommodation space, since the inner component of the sound absorber is integrated in an elastomer portion in the charge-air system, said elastomer portion being required anyhow. In addition, due to the bellows-like outer wall, the sound absorber according to the present invention combines the advantage of a flexible structural design with good sound-absorbing properties.

According to a preferred embodiment, the bellows extends over the whole area of the inner wall provided with the apertures. This guarantees that the synergistic effects resulting from the combination of two principles of action (Helmholtz resonator and $\lambda/4$ reflector) will have effect over the whole effective length or rather the whole effective area of the inner component.

According to an advantageous embodiment, the inner component comprises a hose or a tube, which are each provided with radial apertures. This embodiment offers a particularly simple and reasonably-priced possibility of producing the sound absorber.

The inner component may also comprise hose segments or tubular segments, which are each provided with radial apertures. Due to the fact that the inner component is composed of segments, a particularly good flexibility of the sound absorber is achieved.

In accordance with a preferred embodiment, the inner component is connected to the outer component in that it is thermally formed thereon. This facilitates the production of the sound absorber, since a plurality of connection points and connection areas between the inner component and the outer component can be produced in one operation, i.e. during one heat treatment. The inner component may also be mechanically connected to the outer component.

In accordance with another embodiment, the inner component is integrated in a quick coupling. In this way, the sound absorber can be coupled to connection components and connection lines, respectively, in a particularly simple and fast manner.

It will be advantageous when the outer component is flexible along the whole length of the inner component so that the sound absorber can be fully used as a flexible portion in the charge-air system of an engine.

In accordance with a further preferred embodiment, the outer wall is arranged concentrically with the inner wall. In this way, it is achieved that the cavities formed between the bellows and the inner wall have essentially the same shape and therefore the same volume. The outer wall may also have a conical shape, whereby the cavity volume of the bellows will be altered in the longitudinal direction of the sound absorber.

The materials which proved to be useful for the inner component and the outer component are NBR (nitrile-butadiene rubber), CR (chloroprene rubber), ECO (ethylene carbon monoxide copolymer), AEM (ethylene-acrylic copolymer), ACM (acrylamide rubber), silicone and FPM (fluorocarbon rubber). The outer component and/or the inner component may comprise a pressure carrier, said pressure carrier being not necessary if the inner component is produced from plastic.

In accordance with a further preferred embodiment of the present invention, the bellows extends beyond the inner component in the longitudinal direction of the sound absorber. This means that a part of the bellows comes into direct contact with the gaseous medium conducted in said inner component.

BRIEF DESCRIPTION OF FIGURES

In the following, the invention will exemplarily be described in detail with reference to the schematic drawings enclosed, in which.

DETAILED DESCRIPTION

Figure 2:
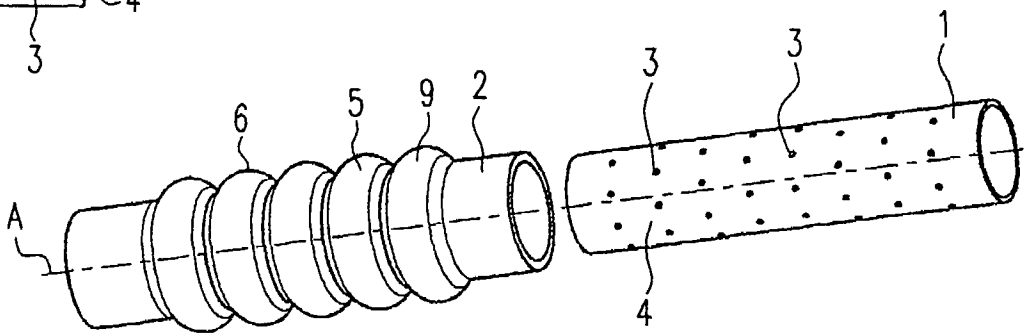
FIG. 2 shows an exploded view of a sound absorber according to FIG. 1.
Figure 3:
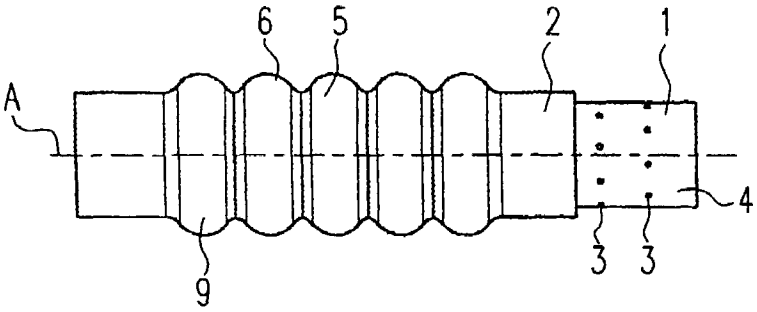
FIG. 3 shows a side view of the sound absorber according to FIG. 1, the inner component being partially inserted into the outer component.
Figure 1:
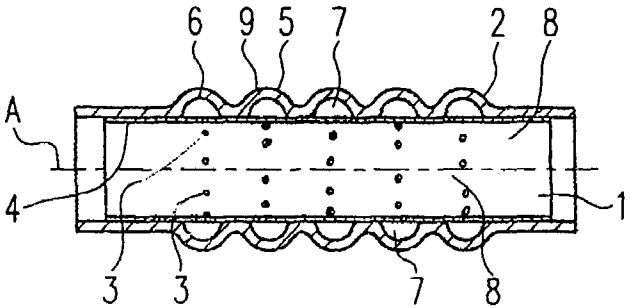
FIG. 1 shows a longitudinal section through a sound absorber in accordance with an embodiment according to the present invention.

The sound absorber or muffler shown in FIG. 1 to 3 is especially, though not exclusively, conceived for use in an internal combustion engine and is arranged as closely as possible to the pressure-side discharge opening of a compressor housing of a turbocharger. The sound absorber shown in FIG. 1 to 3 will, of course, also produce a sound-absorbing effect at other locations of installation, which are not located directly after the turbocharger.

As can best be seen in FIG. 1, the sound absorber comprises an inner component 1, which is inserted in an outer component 2, so that said outer component 2 surrounds the inner component 1. The inner component 1 has, in the longitudinal direction A of the sound absorber, an air inlet and an air outlet as well as connection areas having connected thereto preceding or subsequent components, such as charge-air hoses.

The inner component 1 is implemented as a perforated flexible hose and the outer component 2 is implemented as a bellows-type hose, so that the whole sound absorber has flexible properties. The inner component 1 may also be produced in the form of a rigid tube.

As can additionally be seen in FIG. 1, the inner component 1 defines an inner wall 4 having radial apertures 3 provided therein. The apertures 3 are arranged in parallel rows 8 which extend in the circumferential direction of the inner wall 4, i.e. each row 8 of apertures 3 defines a circle, which has a radius corresponding to the radius of the inner wall 4 and which is arranged at right angles to the longitudinal axis A of the sound absorber. The number of apertures 3 per row may vary; it will be advantageous when eight to twelve apertures 3 per row are provided. A smaller number or a larger number of apertures 3 per row 8 is possible as well.

As can additionally be seen from FIG. 1 to 3, the outer wall 5 surrounding the inner wall 4 is implemeted as a bellows 6. In the mounted condition, i.e. when the inner component 1 is arranged inside the outer component 2, the bellows 6 and the inner wall 4 define individual cavities 7. The respective cavities 7 extend in the circumferential direction of the inner wall 4 parallel to one another.

In the example shown, the bellows 6 is implemented as a hose having a wavelike profile, a pleat 9 being delimited by two wave troughs and one wave crest, with the exception of the outermost pleats. As can be seen in FIG. 1, the cavities 7 formed in the respective wave crests of the pleats 9 are therefore laterally delimited from one another by wave troughs extending in the circumferential direction.

In the present example, the pleats 9 abut on the inner wall 4 in the area of the wave troughs. The individual cavities 7 are therefore sealed from one another.

As can best be seen in FIG. 1, each row 8 of apertures 3 is associated with a cavity 7. This means that the radial apertures 3 of one row 8 are arranged in such a way that they each open into one of the cavities 7. It will be expedient to arrange a row 8 of apertures 3 concentrically with the wave peak of the associated pleat 9. A row 8 which is arranged in displaced relationship with the wave peak of the associated pleat 9 is imaginable as well, provided that it is guaranteed that the apertures 3 of the row 8 open into the respective associated cavity 7. As can be seen in connection with FIG. 1, the bellows 6 is provided along the whole perforated portion of the inner wall 4 and defines there the cavities 7 which communicate through the apertures 3 with the interior of the inner component 1. This will guarantee that the excellent sound absorbing properties will have effect over the entire effective length of the inner component 1.

As can additionally be seen in FIG. 1 to 3, the apertures 3 of neighbouring rows 8 are circumferentially displaced relative to one another in such a way that the respective aperture 3 of one row 8 is arranged centrally between two apertures 3 of the respective neighbouring row 8.

The number of pleats 9 and rows 8 of apertures 3 shown should be considered as an exemplary number. Higher or lower numbers, and in extreme cases only a single pleat 9, are possible.

In the example shown, the outer component 2 has a substantially cylindrical overall shape; the outer circumferential surface, i.e. the outer wall 5, of said outer component 2 is not flat but implemented as a bellows 6. This means that each of the pleats 9 of the bellows 6 has the same diameter and, due to the identical geometry, also the same volume.

It is, however, also possible to provide the outer wall 5 with a conical structural design. In the case of this kind of structural design, the diameter of the outer wall 5 increases along the longitudinal axis A of the sound absorber so that also the diameter of the individual pleats 9 and therefore the volume of said pleats will increase along the length of the sound absorber, whereby the damping frequency range can be influenced. The conical structural design of the outer wall 5 will, in addition, improve the demoulding properties of the outer component 2 in the production process.

The geometry and the number of pleats 9 will be chosen in accordance with the demands that have to be fulfilled with regard to damping and flexibility in the respective case of use. It is imaginable to alter e.g. the cavity volume, in particular the cavity depth, i.e. the distance between the inner wall 4 and the wave peak of a pleat 9, or the radius of curvature of the individual pleats 9.

In the present example, the apertures 3 in the inner wall 4 of the inner component 1 are implemented as radial apertures having a circular cross-section. A different cross-sectional shape, e.g. oval apertures extending in the radial direction, is imaginable as well. It is also possible to implement the apertures 3 as slot-shaped apertures, a slot extending in the circumferential direction in a subsection of the inner wall 4 in such a way that the slot opens into the associated cavity 7.

For maintaining the flexibility of the sound absorber, the inner component 1 may be composed of a plurality of separate tubular segments or hose segments. Each individual segment of the inner component 1 can be mechanically connected to or bonded to the outer component 2. The inner component 1 may be secured to the outer component 2 by single vulcanization or by repeated vulcanization. Mechanical fixing by clips or clamps or rings is possible as well. The inner component 1 can be fixed to the outer component 2 at both ends of the sound absorber or at each individual pleat 9.

Furthermore, the inner component 1 can be implemented as a an injection-moulded part that is integrated in a quick coupling.

In addition, it is possible to use an inner component 1 of reduced length so that the bellows 6 will extend in the longitudinal direction A of the sound absorber beyond the inner wall 4. This portion of the bellows 6 extending beyond the inner wall 4 is not covered by the inner component 1, whereby an influence on the sound-absorbing characteristics of the sound absorber will be achieved.

The materials which may be used for the inner and outer hoses are NBR (nitrile-butadiene rubber), CR (chloroprene rubber), ECO (ethylene carbon monoxide copolymer), AEM (ethylene-acrylic copolymer), ACM (acrylamide rubber), silicone and FPM (fluorocarbon rubber). The inner component may also be produced from plastic material. When flexible hose materials are used, a pressure carrier will be used. The use of a pressure carrier will be expedient, especially in the case of the outer component 2. In cases in which the inner component 1 is made of an elastomer, the pressure carrier can be dispensed with. In cases in which said inner component 1 is made of plastic material, no pressure carrier will be used.

The sound absorber described is particularly useful for reducing noise emissions occurring in turbo-charged Diesel or Otto engines. It goes without saying that the sound absorber can also be used in other fields where airborne sound is to be damped effectively.

The invention claimed is:

1. A sound absorber for an intake of a combustion engine comprising an inner component, said inner component defining an inner wall provided with a plurality of rows of apertures, and an outer component defining an outer wall extending along said inner wall, wherein the outer wall comprises a bellows made of flexible material which, together with the inner wall, defines individual cavities, each cavity having a wave peak, and each single row of apertures of the inner wall opening into a respective cavity and arranged coplanarly with the wave peak of the respective cavity.

2. A sound absorber according to claim 1, wherein the bellows extends over the whole area of the inner wall provided with said apertures.

3. A sound absorber according to claim 1, wherein the inner component comprises a hose or a tube, which are each provided with radial apertures.

4. A sound absorber according to claim 3, wherein the inner component comprises hose segments or tubular segments.

5. A sound absorber according to claim 1, wherein the inner component is connected to the outer component in that it is thermally formed thereon.

6. A sound absorber according to claim 1, wherein the inner component is mechanically connected to the outer component.

7. A sound absorber according to claim 1, wherein the inner component is integrated in a quick coupling.

8. A sound absorber according claim 1, wherein the outer component is flexible along the whole length of the inner component.

9. A sound absorber according to claim 1, wherein the outer wall is arranged concentrically with the inner wall.

10. A sound absorber according to claim 1, wherein the outer wall has a conical shape.

11. A sound absorber for an intake of a combustion engine comprising an inner component, said inner component defining an inner wall provided with a plurality of rows of apertures, and an outer component defining an outer wall extending along said inner wall, wherein the outer wall comprises a bellows made of flexible material which, together with the inner wall, defines individual cavities, each cavity having a wave peak, and each single row of apertures of the inner wall opening into a respective cavity and arranged coplanarly with the wave peak of the respective cavity; and wherein the materials of the inner and outer components comprise at least one of the following materials: NBR, CR, ECO, AEM, ACM, silicone, or FPM.

12. A sound absorber according to claim 1, wherein the inner component is made of plastic material.

13. A sound absorber according to claim 1, wherein at least one of the outer component and the inner component comprise(s) a pressure carrier.

14. A sound absorber according to claim 1, wherein the bellows extends beyond the inner component in the longitudinal direction of the sound absorber.

* * * * *